United States Patent [19]

Burns

[11] Patent Number: 4,595,834

[45] Date of Patent: Jun. 17, 1986

[54] LOW PARALLAX ERROR RADIATION DETECTOR

[76] Inventor: Ronald E. Burns, 57 Frost St., Cambridge, Mass. 02140

[21] Appl. No.: 613,869

[22] Filed: May 23, 1984

[51] Int. Cl.[4] ..... H01J 47/06

[52] U.S. Cl. ..... 250/374; 250/385

[58] Field of Search ..... 250/385, 390, 374

[56] References Cited

U.S. PATENT DOCUMENTS

| | | | |
|---|---|---|---|
| 3,483,377 | 12/1969 | Borkowski et al. . | |
| 3,517,194 | 6/1970 | Borkowski et al. . | |
| 3,603,797 | 9/1970 | Borkowski et al. . | |
| 3,786,270 | 1/1974 | Borkowski et al. | 250/385 |
| 4,048,503 | 9/1977 | Taylor | 250/385 |
| 4,129,782 | 12/1978 | Kreutz | 250/379 |

OTHER PUBLICATIONS

Frieze et al., "A High Resolution Multiwire Proportional Chamber System", Nuclear Instru. & Methods, 136 (1), Jul. 1, 1976, pp. 93–97.

R. W. Hendricks, "One-And Two-Dimensional Position-Sensitive X-Ray and Neutron Detectors", pp. 103–146, Transactions of the American Crystallographic Association, 1976.

*Primary Examiner*—Alfred E. Smith
*Assistant Examiner*—Carolyn E. Fields
*Attorney, Agent, or Firm*—Kenway & Jenney

[57] ABSTRACT

An imaging proportional counter which significantly reduces parallax errors when imaging point sources of radiation located at variable distances from the detector entrance window. The imaging proportional counter includes a gas filled enclosure with a concave shallowly curved radiation permeable entrance window allowing radiation from the source to enter the enclosure. A multi-wire grid assembly is spaced behind the entrance window within the enclosure. When a potential difference is applied between the grid assembly and concave entrance window an electrostatic field is generated such that near the interior surface of the window the field lines form a spherically focussed region. The concave entrance window also allows increased fill gas pressures such that radiation entering the detector will interact with the fill gas very near the entrance window while still in the spherically focussed region. Free electrons produced in the interaction drift along the curved electrostatic field lines to the detector electrode assembly where electronic signals are produced indicative of the two-dimensional coordinates of the location where the radiation entered the detector. The combination of a concave radiation entrance window with increased fill gas pressure reduces parallax errors in applications where the point source of radiation is located a distance from the detector that is less than approximately four times the radius of curvature of the window.

4 Claims, 3 Drawing Figures

LOW PARALLAX ERROR RADIATION DETECTOR

BACKGROUND OF THE INVENTION

This invention relates to the design of imaging proportional counters (IPC) (also called multi-wire proportional counters or two-dimensional proportional counters) for imaging radiation from point sources located near the imaging device. An IPC is a radiation detector that uses gas as the detection medium and determines the position coordinates where radiation interacts with the fill gas.

Ionizing radiation and X-radiation imaging devices are useful in many fields such as X-ray diffraction, X-ray crystallography, nuclear physics, diagnostic radiology, nuclear medicine, DNA sequencing, etc. A well known X-ray imaging technique employs the photographic process. In this process photons (either visible light or X-ray) or ionizing radiation interact with the photographic emulsion to generate an image. Disadvantages of the photographic technique are the relative insensitivity of film, especially in X-ray applications, and the time required to develop and read film. Imaging proportional counters have been developed to produce good sensitivity and spatial resolution. Images can be collected directly in computer memory and processed quickly and easily.

Generally, imaging proportional counters have a gas filled envelope including a radiation pervious window. X-radiation or ionizing radiation traverses the window into the interior of the envelope. Ionizing radiation directly ionizes the fill gas leaving a trail of free electrons. X-radiation moves through the fill gas until it interacts with a fill gas atom producing a photo-electron. The photo-electron then moves a relatively short distance, ionizing the fill gas and producing a small cloud of free electrons. These free electrons created by the interaction of radiation in the fill gas are called primary electrons. Typically a few hundred primary electrons will be created. An electrostatic field is maintained in the region between the entrance window and a detector electrode assembly. Under the influence of this field the primary electrons drift toward the anode of the detector electrode assembly. As the primary electrons enter the high electric fields near the anode, amplification of the signal occurs. Several techniques are known for determining the position of the amplified signal. Generally, mutually orthogonal wire planes are used to collect charge and determine the location of the centroid of the amplified charge distribution.

If the measured location of the radiation event is to have a meaningful relation to the actual location of the primary event (if from an X-ray) or primary track (if from an ionizing particle) the primary electrons must drift to substantially the same location on the anode plane independent of the angle of the incoming radiation. This is a significant concern when imaging x-radiation since X-ray photons entering the detector at the same location and angle may penetrate the gas significantly different distances before interacting with a fill gas atom. This error in the measured position which is a function of the angle of the incoming radiation is called a parallax error.

A radiation camera disclosed in U.S. Pat. No. 3,786,270 to Borkowski et al. eliminates parallax errors when imaging X-rays from a point source by providing spherically symmetric electrostatic fields so that no matter where along a photon's trajectory within the interaction region a photo-electron is ejected, the resulting primary electrons drift to the same location at the anode of the detector. While the Borkowski radiation camera provides an elegant theoretical solution to the parallax problem, it has several drawbacks in actual application. The source of radiation must be located at a fixed, predetermined distance from the radiation pervious window of the detector. Thus, only a limited class of experiments can be performed with this camera. Furthermore, the Borkowski device requires spherically shaped wire mesh grid for its operation. Such a grid is difficult to fabricate so that it will retain its dimensional stability during operation of the radiation camera.

It is therefore an object of the present invention to provide a radiation detector which is capable of accurately imaging radiation from point sources located at varying distances from the apparatus.

Another object is the elimination of the need for a curved mesh focusing electrode within the detector.

A still further object of the invention is radiation camera which is simpler and more versatile than prior art detectors.

SUMMARY OF THE INVENTION

The objects of the invention are achieved in an imaging proportional counter which combines reductions in parallax errors produced both by a focussed geomery entrance window and by fill gas content and pressure.

The counter includes a gas tight housing having a concave radiation pervious entrance window. The entrance window has a preselected radius of curvature and depth. Orthogonally disposed electrode planes form the detector electrode assembly. The electrode assembly is spaced away from the window within the housing, preferably by a distance approximately equal to the depth of the window. The IPC housing is filled with a gas which will produce photo-electric interactions with the incoming x-radiation very near the entrance window. The gas should have a half absorption layer thickness, that is, the distance within which half of the incoming X-rays are stopped, of less than 0.05 of the radius of curvature of the window. It is preferred that the thickness be approximately 0.01 of the radius of curvature of the window or less. Appropriate voltages are applied to the electrode assembly to produce an electrostatic field in the space between the entrance window and electrode assembly such that near the interior surface of the entrance window the electrostatic field lines are spherically symmetric and focussed on the center of curvature of the concave window. In this case electrons from the primary ionization event will drift along a curved path from the point of interaction into the detector electrode assembly where signals are produced indicative of the two-dimensional coordinates at the location where the radiation entered the detector.

The invention can be optimized for a wide range of applications by adjusting the front window curvature, material, and thickness and by adjusting the fill gas content and pressure. Parallax errors are reduced to an acceptable level by combining improvements that can be attained both by reducing the penetration of X-rays in the fill gas and by providing the spherically focussed interaction region created by a concave entrance window.

The depth of penetration of X-rays is a function of the X-ray energy and the stopping power of the fill gas. The stopping power, measured by the half absorption layer thickness, can be increased by selecting noble gases of higher atomic number and by raising the pressure of the gas within the detector housing. A concave curved entrance window produces a focussed geometry which eliminates parallax errors when the X-ray source is located at the radius of curvature of the window and also the concave window allows higher fill gas pressures than would be attainable with a flat window of similar material and thickness. This reduction in X-ray penetration through the fill gas eliminates the need for a curved mesh electrode.

The combined effects of fill gas content and pressurization, and focussed geometry produce substantially reduced parallax errors when imaging X-rays from point sources located less than four times the radius of curvature of the entrance window away from the detector. Also, elimination of the curved mesh electrode eliminates problems associated with the grids' electron transparancy and simplifies detector construction.

BRIEF DESCRIPTION OF THE DRAWING

The invention disclosed herein will be understood better with reference to the drawing of which.

DESCRIPTION OF THE PREFERRED EMBODIMENT

Figure 1:
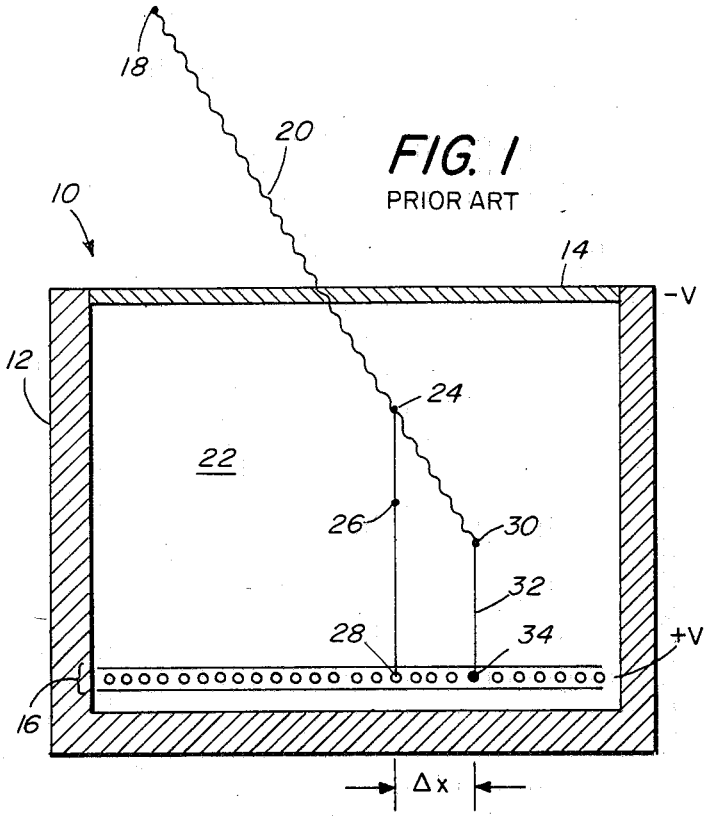
FIG. 1 PRIOR ART
FIG. 1 is a schematic view of a prior art detector employing linear drift fields.

FIG. 1 is a prior art radiation camera 10 employing a linear drift field. Such a camera is taught in FIG. 4 of the referenced patent, U.S. Pat. No. 3,786,270 to Borkowski et al. The radiation camera 10 includes a gas-tight housing 12 containing a gas such as methane, argon, krypton, or xenon at a pressure of less than two atmospheres. A window 14 is provided which is pervious to radiation. A multi-wire detector electrode assembly 16 includes orthogonally disposed cathode electrodes for determining the location of an interaction within the detector 16.

In operation, a source of x-radiation 18 emits a photon which travels along a path 20 through the window and into the interior of the housing 12. The photon traveling along the path 20 is likely to interact with an atom of gas 22 contained within the housing 12. If, for example, a photon interacts with a gas atom at location 24, a photoelectron will be ejected from the gas atom and create a small cloud of primary ionization at location 24. The primary ionization electrons will drift downwardly under the influence of a linear electrostatic field created by a potential difference between the window 14 and the detector electrode assembly 16. Because of the geometry of the radiation camera 10, the primary electrons 26 will drift downwardly in a straight line and will ultimately interact with the detector 16 at a location 28 where charge amplification will occur. External circuitry (not shown) can then determine the two-dimensional coordinates of the location of the interaction point 28. If, however, the photon traveling along path 20 does not interact with an atom of gas 22 until at location 30, the primary electrons will drift downwardly along a path 32 and interact with the detector 16 at a location 34. Thus, the position measured by the camera 10 will depend upon where along the path 20 the photon interacts with a gas atom. This parallax effect will thus produce an error delta X in the measured location of the radiation event.

Figure 2:
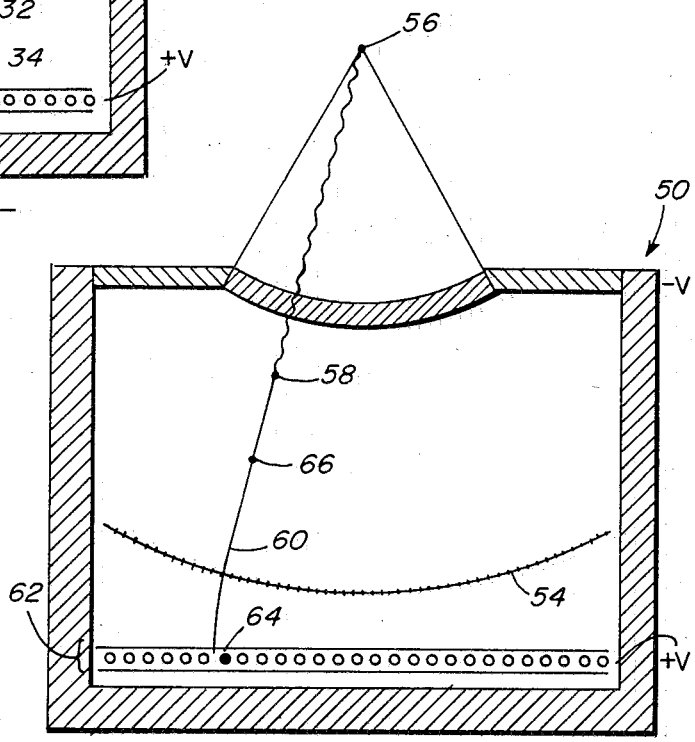
FIG. 2 PRIOR ART
FIG. 2 is a schematic representation of a prior art radiation camera employing spherically symmetric drift fields.

A solution to the parallax problem was disclosed in FIG. 6 of the Borkowski et al. patent. FIG. 2 is a representation of the solution developed by Borkowski et al. A radiation camera 50 includes a concave, dish-shaped radiation pervious entrance window 52 and a dish-shaped wire mesh grid 54, both of which have a radii of curvature equal to their distance from the source of radiation 56. The spherical shapes of the window 52 and the grid 54 will produce spherically symmetric electrostatic fields when appropriate voltages are applied to them. The spherical grid 54 is spaced some distance behind the entrance window 52. This distance is such that an X-ray of the desired energy will have a large probability of interacting with a gas atom while traversing the space between the entrance window 52 and the spherical grid 54. A typical detector of this type when designed to image 8 Kev X-rays would use an argon fill gas and have an interaction space of 10 to 15 cm. In application, if a photon emitted by a source 56 encounters a gas atom at a location 58, the primary electrons will travel along a path 60 and encounter the detector electrode assembly 62 at a location 64. Alternatively, if the photon does not interact with a fill gas atom until it reaches a location 66, the primary electrons will still drift along the path 60 and strike the electrode assembly at the same location 64. Thus, any error due to parallax has been eliminated by using this focussing geometry which includes a curved entrance window 52 and curved grid 54.

A substantial disadvantage of the radiation camera 50 taught by Borkowski et al. is that the radiation source 56 must remain at a single, fixed location with respect to the entrance window 52. The location 56 is generally designed to produce a 30 degree to 60 degree field of view at the entrance window. If the radiation source were moved away from the focal point (the center of the radius of curvature of the front window) the design would not give error-free results. The camera could not then be used both for wide angle X-ray crystallographic applications and also for small angle diffraction experiments.

A further problem with the camera 50 is the need for a dish-shaped electrode 54 which is transparent to electrons. The dish-shaped electrode is difficult to fabricate because individual wires in a mesh do not yield uniformly during the forming process and the resulting grid does not maintain its proper shape. Also, since the dish-shaped electrode is near the detector grid assembly, there are large differences in the electric field between the center and edges in the region between the dish-shaped electrode and the electrode assembly. This contributes to an electron transparency problem. In typical applications of this geometry, if the dish-shaped electrode is operated at such a voltage that primary ionization is not lost during the drifting between the dish-shaped electrode and the detector grid assembly near the edges of the field of view, then the electric field at the center is too high. When the electric field in the center of the region between the dish-shaped electrode and the detector grid becomes larger than the field inside the electrode assembly then the upper wire plane in the electrode assembly becomes non-transparent to electrons. (This is basically the way a grid in a vacuum tube works, however, in this case the detector stops working since electrons near the center of the detector can't penetrate the upper electrode to be amplified and positioned by the electronics).

Figure 3:
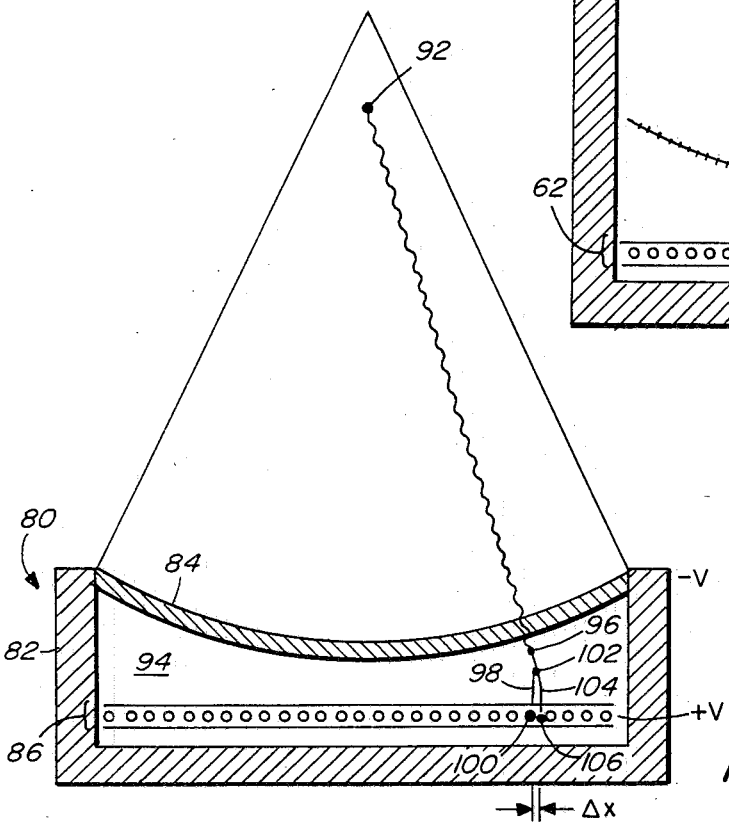
FIG. 3 is a schematic representation of the detector disclosed herein.

The present invention illustrated in FIG. 3 combines some features of the focussed geometry Borkowski design with selection and pressurization of the fill gas to produce a camera that controls parallax errors and can be operated over a wide range of source to detector distances. In addition, the present invention eliminates problems associated with the dish-shaped electrode which is required in the Borkowski design.

In FIG. 3 the radiation detector 80 includes a gas-tight housing 82 having a shallowly curved, radiation pervious entrance window 84 made of beryllium and a detector electrode assembly 86. The electrode assembly 86 is shown as including multi-wire electrode planes, but it should be understood that other electrode assemblies such as printed circuit electrodes can be used. A typical implementation of this design would have the entrance window be a 30 degree dish with a radius of curvature between one and two times the distance from the window to the source, and with the detector grid assembly placed a distance behind the dished window that is approximately equal to the depth of the dish. A typical thickness for the window 84 is 1 mm. A key to this invention is the selection of a fill gas that will stop an incident X-ray very near the entrance window. In particular, the gas should have a half absorption layer thickness of less than 0.05 of the radius of curvature of the entrance window for meaningful diminution of parallax errors. It is preferred that the half absorption layer have a thickness on the order of 0.01 of the entrance window radius of curvature or less. The 0.01 value can be achieved for most X-ray diffraction applications using xenon pressurized to approximately 4 atmospheres. Since the electric field lines in the interaction region must be perpendicular both to the entrance window and the detector grid assembly, electrons from primary ionization will drift in an arc from the front window 84 to the detector grid assembly 86. In the region near the front window the field lines form a spherically symmetric region just as in the Borkowski configuration.

The depth of this spherically symmetric region is much smaller than in the Borkowski detector. However, if the X-rays interact near the front window, the errors will be small. If, for example, an X-ray is emitted from a source located at 92, the photon will pass through the entrance window 84, preferably made of beryllium, and interact with an atom of gas 94 very near the front window at a location 96. The primary electrons will drift along a path 98 and be detected at position 100. If on the other hand, the photon were to interact with a gas atom at location 102, the primary electrons will drift along a path 104 and be detected at a location 106 creating an error of delta x. Unlike the situation in the prior art as illustrated in FIG. 1, the error is very small. A typical application might use 8 Kev X-rays, an entrance window with a 240 mm radius of curvature and a xenon fill gas at 4 atmospheres. In such a case, half of the X-ray photons will interact within 1 mm of the front window. The error introduced by the fact that the electrostatic field lines curve from the entrance window is not measurable. Increasing the stopping power of the fill gas has the effect of reducing the required distance between the entrance window 52 and dished electrode 54 in FIG. 2 of the Borkowski design. In this example, the present invention has reduced that required distance to about 2 mm at which point the dished electrode is no longer needed, a significant advantage of the present invention.

An important aspect of the present invention is that a combination of focussing window geometry and increased stopping power (decreased half absorption layer thickness) in the fill gas are being used to control parallax at a level where the parallax errors are less than other sources of error within the camera but not necessarily eliminated completely. For example, if an X-ray source is located a distance in front of the camera that is less than two times the radius of curvature of the entrance window, the effect of the curved entrance window will be to reduce the parallax error. Also, in every situation, increasing the fill gas pressure will reduce parallax errors. The two techniques further reinforce one another in the sense that the concave entrance window can withstand much higher pressures than a flat window of similar material and thickness.

In the prior art, it was not thought possible to operate such detectors at pressures substantially greater than one atmosphere, because such a detector would have to have a window strong enough to contain the pressure and also have low absorption characteristics to permit penetration by ionizing radiation and x-radiation. For example, see "One and Two Dimensional Position Sensitive X-ray and Neutron Detectors" by R. W. Hendricks at page 129. The inventor herein has found that a concave X-ray window can be fabricated which will contain the fill gas at high pressure and at the same time be sufficiently transparent to x-radiation. In addition, the concave entrance window provides a geometric focussing effect which further reduces parallax errors.

The invention came about as a result of the present inventor realizing that although the Borkowski camera provided a solution to the parallax problem, it was limited to imaging radiation sources located at a single fixed distance from the detector's entrance window, thereby limiting the usefulness of the camera to a small class of experiments. In addition, the Borkowski camera required a spherically-shaped mesh grid whose dimensional stability is hard to insure and which introduced additional electrostatic field problems within the detector. The present inventor recognized that if a detector could be constructed to operate with a higher pressure fill gas, X-ray photons could be stopped very near the entrance window thereby reducing parallax errors. In addition, if the entrance window were curved it would provide geometric focussing as in the Borkowski camera without the need for a problematic curved mesh electrode.

It is thus seen that the objects of this invention have been achieved in that there has been described a radiation detection apparatus which can be used to image radiation sources located over a wide range of distances from the detector and which also eliminates the need for an internal curved wire mesh grid. The apparatus achieves these results by implementing a concave spherical entrance window and operating at a significantly higher pressure than used in prior art detectors. The high pressure increases the stopping power of the gas so that variation in the location of photon interactions with gas atoms is small enough so that parallax errors are limited to a range that does not degrade the resolution of the imaging proportional counter. Thus, the detector disclosed and claimed herein is more versatile than radiation cameras heretofore known and is simpler and easier to build and operate. Furthermore, the need for a curved mesh electrode is eliminated. It is recognized that modifications and variations of the detector disclosed and claimed herein will occur to those skilled in the art and it is intended that all such modifications and variations be included within the scope of the appended claims.

What is claimed is

1. Apparatus for imaging radiation from sources located at variable distances from the apparatus comprising:

a gas tight housing including a concave radiation permeable entrance window having a preselected radius of curvature and depth which allows radiation from point sources to enter the interior of the housing;

a detector electrode assembly spaced apart from the window;

a gas contained within the housing having a half absorption layer thickness less than 0.05 of the radius of curvature of the window; and means for producing an electrostatic field between the entrance window and the detector electrode assembly, the electrostatic field being spherically symmetric near the entrance window and focused on the center of curvature of the window.

2. The apparatus of claim 1 for operation with 8 KEV X-rays wherein said gas is xenon pressurized to approximately four atmospheres.

3. The apparatus of claim 1 wherein the electrode assembly is spaced from the entrance window by an amount approximately equal to the depth of the window.

4. The apparatus of claim 1 for operation with 8 KEV X-rays, wherein the entrance window is a 30° arc at a 240 mm. radius of curvature and made of 1 mm thick beryllium.

* * * * *